US008122783B2

(12) United States Patent
Olson et al.

(10) Patent No.: US 8,122,783 B2
(45) Date of Patent: Feb. 28, 2012

(54) JOYSTICK AND METHOD OF MANUFACTURING THE SAME

(75) Inventors: Jesse W. Olson, Mayer, MN (US); Joseph K. Krueger, Minneapolis, MN (US)

(73) Assignee: Sauer-Danfoss Inc., Ames, IA (US)

( * ) Notice: Subject to any disclaimer, the term of this patent is extended or adjusted under 35 U.S.C. 154(b) by 1042 days.

(21) Appl. No.: 12/035,635

(22) Filed: Feb. 22, 2008

(65) Prior Publication Data

US 2009/0212766 A1 Aug. 27, 2009

(51) Int. Cl.
*G05G 9/047* (2006.01)

(52) U.S. Cl. ..... 74/471 XY

(58) Field of Classification Search ..... 74/473.34, 74/473.35, 471 XY; 403/122, 135; 324/207.2, 324/207.24, 207.25; 702/33, 36, 38; 463/38; 200/6 A See application file for complete search history.

(56) References Cited

U.S. PATENT DOCUMENTS

| | | | | |
|---|---|---|---|---|
| 4,489,303 | A | 12/1984 | Martin | |
| 4,500,867 | A | 2/1985 | Ishitobi et al. | |
| 4,622,644 | A * | 11/1986 | Hansen | 702/153 |
| 5,160,918 | A | 11/1992 | Saposnik et al. | |
| 5,421,694 | A | 6/1995 | Baker et al. | |
| 5,576,704 | A | 11/1996 | Baker et al. | |
| 5,692,541 | A | 12/1997 | Brown | |
| 5,850,142 | A | 12/1998 | Rountos | |
| 5,969,520 | A | 10/1999 | Schottler | |
| 6,002,351 | A | 12/1999 | Takeda et al. | |
| 6,580,269 | B2 | 6/2003 | Hiligsmann et al. | |
| 6,580,418 | B1 | 6/2003 | Grome et al. | |
| 6,606,085 | B1 * | 8/2003 | Endo et al. | 345/161 |
| 6,992,602 | B2 | 1/2006 | Alexander et al. | |
| 7,235,968 | B2 | 6/2007 | Popovic et al. | |
| 2006/0228167 | A1 * | 10/2006 | Spratte et al. | 403/122 |

FOREIGN PATENT DOCUMENTS

| | | | |
|---|---|---|---|
| DE | 197 49 330 | A1 | 5/1999 |
| DE | 102006037526 | A1 | 10/2006 |
| DE | 102006038088 | A1 | 3/2007 |
| EP | 1310854 | A1 | 5/2003 |
| EP | 1464918 | | 10/2004 |
| GB | 2450342 | A | 12/2008 |
| JP | 2008123614 | A | 5/2008 |

OTHER PUBLICATIONS

Web page of MLX90333 Triaxis 3D-Joystick Position Sensor, May 23, 2007, Ieper, Belgium.

Examination Report for Office Action dated Nov. 19, 2010 issued by German Patent Office of German Patent Application No. 10 2009 006 405.2 filed Jan. 28, 2009 (based on U.S. Appl. No. 12/035,635, filed Feb. 22, 2008).

* cited by examiner

*Primary Examiner* — Vicky Johnson
(74) *Attorney, Agent, or Firm* — Zarley Law Firm, P.L.C.

(57) ABSTRACT

A joystick having a movable member that includes a shaft portion and a spherical portion wherein the shaft portion has a diameter less than the spherical portion. An actuating member is secured to the shaft portion of the movable member to provide actuation of the movable member. A magnet is disposed within the spherical portion of the movable member and positioned adjacent a three axis sensor such that the magnet moves in a hemispherical pattern along the three axis sensor to operate a device.

20 Claims, 2 Drawing Sheets

JOYSTICK AND METHOD OF MANUFACTURING THE SAME

BACKGROUND OF THE INVENTION

This invention relates to joysticks. More specifically, this invention relates to a joystick using a three axis Hall Effect sensor in order to provide operation of a device.

Joysticks have been used for many years for varying operations. Joysticks not only have been used in gaming arts but additionally have been used in association with hydraulic devices such as cranes, fork lifts and the like. Specifically, joysticks allow for compact multi-dimensional actuation of a device. Known in the art are several types of joysticks including joysticks based on a "gimbal" mechanism wherein a magnet moves on a hemisphere centered at the IC (the sensor). Specifically, axial magnetization is provided wherein the flux density is provided through the following equations:

$$B_x=\mathrm{SIN}(\alpha)\mathrm{COS}(\beta)$$

$$B_y=\mathrm{COS}(\alpha)\mathrm{SIN}(\beta)$$

$$B_z=\mathrm{COS}(\alpha)\mathrm{COS}(\beta)$$

Another type of joystick that exists is considered a "ball and socket" joint wherein the magnet moves on a hemisphere centered about the pivot point. Specifically, axial magnetization is provided wherein the flux density is described through a slightly more complex set of equations as can be shown as follows:

$$\alpha=\mathrm{ATAN}(V_x/((K_zV_z)^2+(K_tV_y)^2)^{1/2})$$

$$\beta=\mathrm{ATAN}(V_y/((K_zV_z)^2+(K_tV_x)^2)^{1/2})$$

In both applications multiple pieces are used in order to manufacture the joysticks. For example, in the "gimbal" mechanism a main shaft is provided with a magnet at the end wherein the shaft is attached to a movable device that has a center axis aligned with the three axis sensor. Thus, as the shaft pivots about this axis the movement of the magnet is detected by the three axis sensor. As a result of the multiple pieces provided to manufacture this joystick the manufacturing process is expensive.

Therefore, a principle object of the present invention is to provide an improved joystick that allows for sensing three axis directional movement.

Yet another object of the present invention is to provide a cost effective method of manufacturing a joystick.

These and other objects, features, or advantages of the present invention will become apparent from the specification and claims.

BRIEF SUMMARY OF THE INVENTION

A joystick having a movable member that is of one-piece construction that extends from a shaft portion to a spherical portion wherein the diameter of the shaft portion is less than the diameter of the spherical portion. An actuating member is secured to the shaft portion of the movable member to provide actuation of the movable member. A magnet is disposed within the spherical portion of the movable member at the bottom of the sphere extending upwardly and is off center from a center point of the spherical portion. A three axis sensor is disposed underneath, adjacent, and in spaced relation to the spherical portion and magnet of the movable member such that movement of the actuating member positions the magnet in a hemispherical pattern along the three axis sensor.

DETAILED DESCRIPTION OF THE PREFERRED EMBODIMENT

Figure 1:
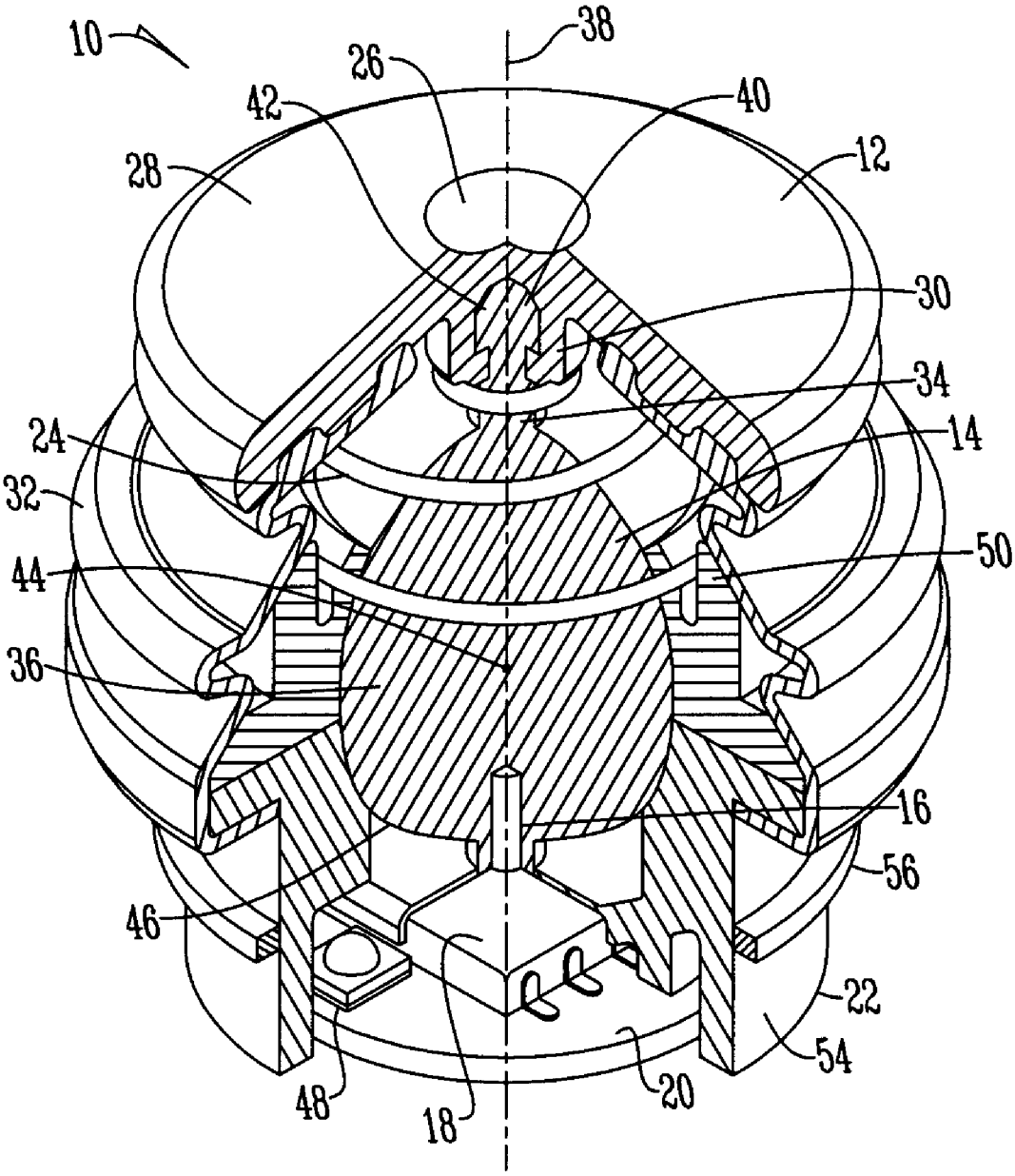
FIG. 1 is a side cut away perspective view of a joystick.
Figure 2:
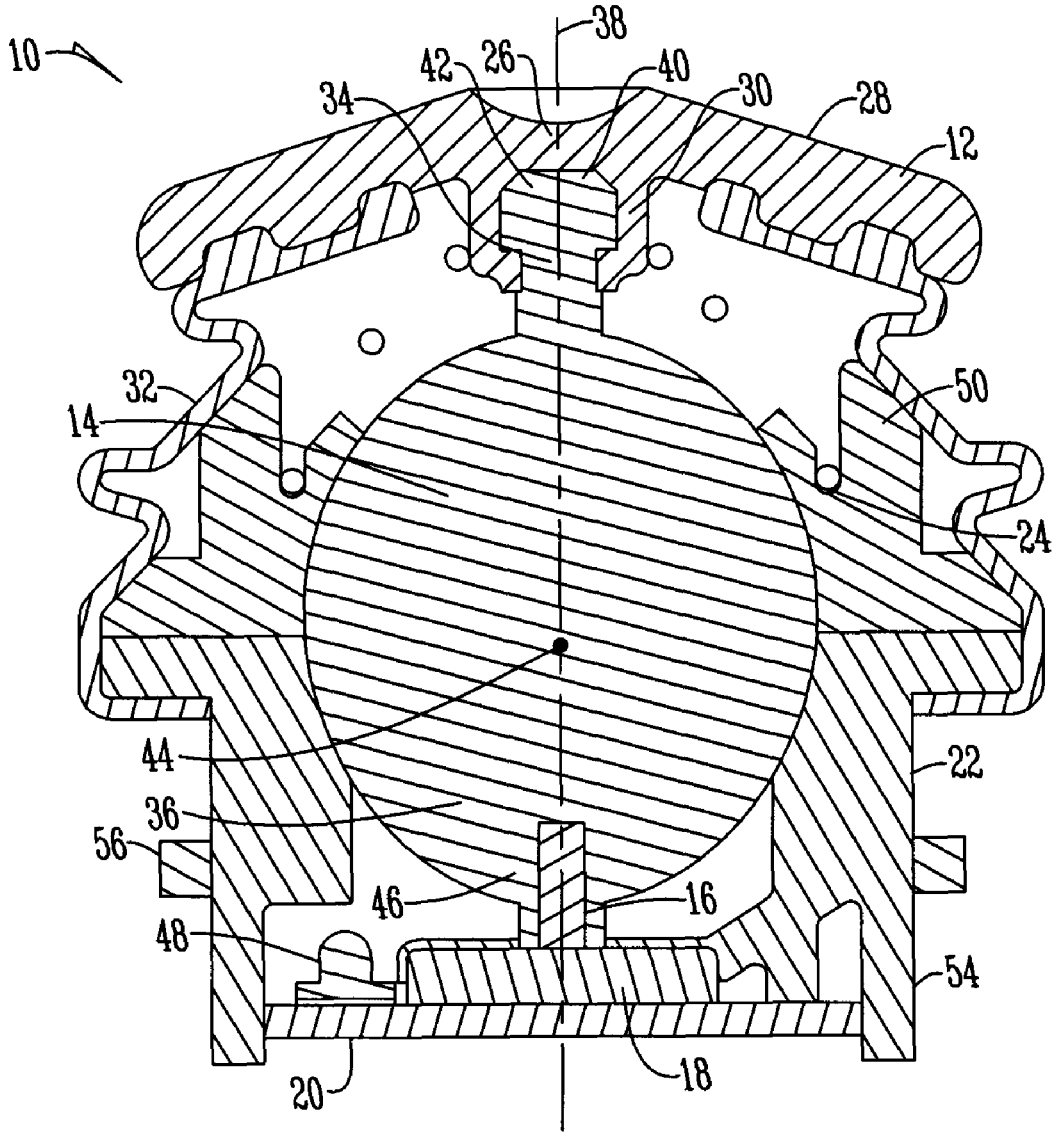
FIG. 2 is a sectional view of a joystick.

The figure shows a joystick 10 that is comprised of an actuating member 12 such as a knob that is used to actuate a movable member 14 that contains a magnet 16 disposed therein such that movement of the movable member 14 is sensed by a three axis sensor 18. The three axis sensor is electrically connected to a PBC (printed circuit board) 20 and the components are disposed within a housing 22 wherein a conical spring 24 connects the housing 22 to the movable member 14. While the three axis sensor 18 may be any sensor that is able to detect three axes of movement in a preferred embodiment the three axis sensor 18 is a three axis Hall Effect sensor. Additionally, the actuating member 12 is able to move in any axial direction and is biased by the conical spring 24 to a non-actuated or neutral position wherein no net force is provided on the actuating member 12.

The actuating member 12 is conically shaped having a centrally located concave portion 26 located on a top surface wherein a side wall 28 extends outwardly and downwardly from the centrally located concave portion 26. Extending from the bottom of the actuating member 12 is a centrally located annular flange 30 that extends downwardly to receive the movable member 14. A seal 32 contacts the bottom of the actuating member 12 and surrounds the housing 22 to connect the housing 22 to the actuating member 12. As a result of the structure of the actuating member 12 movement in any direction is provided.

Movable member 14 is comprised of a shaft portion 34 and a spherical portion 36 that extends from the shaft portion 34. Specifically, the shaft portion 34 has a diameter that is less than the diameter of the spherical portion 36. Both the shaft portion 34 and spherical portion 36 are centered on a central axis 38 upon which the movable member could be rotated. The shaft portion 34 is at a first end 40 of the movable member 14 and has a rounded section 42 that rotatably fits within the annular flange 30 of the actuating member 12. Meanwhile, the spherical portion 36 has a center point 44 located along the central axis 38 and extends to a second end 46 wherein the magnet 16 is located. Specifically, the magnet 16 extends from the second end 46 towards the center point 44 of the spherical portion 36. In a preferred embodiment the magnet 16 is a cylindrical magnet and does not extend to the center point 44 and thus is considered off center.

Disposed below the magnet 16 and in spaced relation is a three axis sensor 18 that is electrically connected to a PCB (printed circuit board) 20. Additionally, electrically connected on the printed circuit board 20 is a light emitting diode (LED) 48. The operation of the LED 48 is independently controlled. The LED 48 can be triggered to indicate specific operating modes, or can be turned on continuously to provide backlighting. In a preferred embodiment the actuating member 12 and movable member 14 are both made of a transparent material such that when the light emitting diode emits light a user can detect the light. Further, in a preferred embodiment the transparent material is a plastic, and more specifically, injected molded plastic.

The housing 22 extends from a first end 50 to a second end 54 adjacent the printed circuit board 20. The conical spring 24 extends between the first end 50 and around the shaft portion 34 of the movable member 14 to provide a biasing force on the actuating member 12. Thus, the conical spring 24 always forces the actuating member 12 to a non actuated or neutral position. Additionally, surrounding the housing 22 is a retainer 56 adjacent the second end 54 of the housing 22 such that the joystick 10 may be placed into and retained within a device.

During the manufacturing process, plastic is injection molded in order to form the movable member 14. Specifically, the plastic is molded to provide the shaft portion 34 and spherical portion 36 wherein the shaft portion has a diameter less than the diameter of the spherical portion 36. During the injection molding process magnet 16 is over molded in the spherical portion such that the shaft portion 34, spherical portion 36, and magnet 16 are all within one single component. In a preferred embodiment the plastic is transparent such that the magnet 16 may be seen by an observer after injection molding occurs.

Next, during the manufacturing process the actuating member 12 is secured to the rounded section 42 of the movable member 14. Next, the three axis sensor 18 is placed on a printed circuit board 20 and a light emitting diode 48 is placed adjacent to the three axis sensor 18. At that point in time the printed circuit board 20 is placed underneath and adjacent to the second end 46 of the movable member 14 such that movement of the actuating member 12 positions the magnet 16 in a hemispherical pattern along the three axis sensor 18.

The printed circuit board 20 and movable member 14 are disposed within housing 22 such that the printed circuit board 20 is adjacent the second end 54 of housing 22. The conically shaped coil 24 is inserted between first end 50 of housing 22 and around the shaft portion 34 of the movable member 14 to provide the needed biasing force. At this point in time the seal 32 is secured between the actuating member 12 and housing 22. Thus, the end result is joystick 10.

The resulting joystick 10 provides a magnet 16 that is embodied into a movable member 14 for the use of triggering a three axis sensor 18 within a joystick application. The three axis sensor 18 senses the position of the magnet 16 in relationship to the surface center of the sensor 18. The movement of the magnet position is achieved by the use of a ball and socket type design.

By using the injection molding process three elements; the magnet 16, the spherical ball portion 36 and shaft portion 34 are all presented in a single component. The magnet 16 is positioned axially along the central axis 38 of the shaft portion 34 and is located off the center point 44 of the spherical portion 36. This allows for the magnet 16 to be positioned in an infinitely hemispherical pattern along the surface of the sensor 18 about the center point 44 of the spherical portion 36 of the movable member 14 during actuation.

The use of this design also allows for axial rotation of the magnet 16 encompassing another potential function within the joystick 10. Meanwhile, the incorporation of the light emitting diode 48 into the system using the printed circuit board 20 in conjunction with using translucent material for the actuating and movable members 12, 14 allows light to be emitted for operator interface. The use of plastic material, injection molding process and part incorporation, also reduces the overall cost of the joystick 10. Preferably, the movable member and specifically the shaft portion 34 and spherical portion 36 are injection molded with the magnet 16 being over molded all within a single process or operation.

The above discussed joystick 10 and manufacturing process provide several advantages over previous joysticks provided. Specifically, the feature of the movable member 14 having both the shaft portion 34 and spherical portion 36 in one entity and comprised of an austenitic material provides reduction in manufacturing cost and allows the light emitting diode 48 to be seen when it is illuminated. Additionally, the location of the magnet 16 within the spherical portion 36 wherein the magnet is positioned axially along the central axis 38 of the shaft portion 34 and is located off center of the spherical portion 36 is new and provides for enhanced detection and operation.

Another feature and advantage is the incorporation of the axial rotation function with the spherical portion 36 and actuating shaft assembly. Further, the use of the conical compression spring 24 allows the spring 24 to act on the top housing and movable member 14 to bias the movable member 14 back to a neutral position. Specifically, the conical compression spring 24 has a bending load induced during actuation and after release the bending load reactive force is used to return the movable member 14 and actuating member 12 to neutral.

Another advantage is the use of the light emitting diode 48 within the joystick 10. Thus, when the movable member and actuating member 14, 12 are made of a translucent material the emitted light can be carried to the point of operator interface. Therefore, at the very least all of the stated objectives have been met.

It will be appreciated by those skilled in the art that other various modifications could be made to the device without departing from the spirit and scope of this invention. All such modifications and changes fall within the scope of the claims and are intended to be covered thereby.

What is claimed is:

1. A joystick comprising:

a movable member extending from a shaft portion at a first end to a spherical portion terminating at a second end wherein the diameter of the shaft portion is less than the diameter of the spherical portion;

an actuating member secured to the shaft portion of the movable member;

a magnet disposed within and extending from the second end of the spherical portion of the movable member; and a three axis sensor disposed underneath and adjacent the second end of the spherical portion of the movable member such that movement of the actuating member positions the magnet in a hemispherical pattern along the three axis sensor to operate a device;

wherein the movable member and actuating member are made of a transparent material; and wherein a light emitting diode is detected by a user through the transparent material of the movable member and actuating member.

2. The joystick of claim 1 wherein the movable member is of one piece construction.

3. The joystick of claim 1 wherein the transparent material is plastic.

4. The joystick of claim 1 wherein the movable member is formed using an injection molding process wherein the magnet is over molded.

5. The joystick of claim 1 wherein the shaft portion of the movable member has a central axis and the magnet is positioned axially along the central axis.

6. The joystick of claim 5 wherein the spherical portion of the movable member has a center point and the magnet is not located on the center point.

7. The joystick of claim 1 further comprising a housing surrounding the movable member at a first end and extending to a second end that surrounds the three axis sensor.

8. The joystick of claim 7 wherein a conical compression spring is secured between the first end of the housing and around the shaft portion of the movable member to create a biasing force on the movable member to bias the movable member to a neutral position wherein no net force exists on the movable member.

9. The joystick of claim 7 wherein a seal is disposed around the housing and connects the housing to the actuating member.

10. The joystick of claim 1 wherein the magnet is a cylindrical magnet.

11. A joystick comprising:

a movable member extending from a shaft portion at a first end to a spherical portion terminating at a second end wherein the diameter of the shaft portion is less than the diameter of the spherical portion;

an actuating member secured to the shaft portion of the movable member;

a magnet disposed within and extending from the second end of the spherical portion of the movable member; and a three axis sensor disposed underneath and adjacent the second end of the spherical portion of the movable member such that movement of the actuating member positions the magnet in a hemispherical pattern along the three axis sensor to operate a device;

a housing surrounding the movable member at a first end and extending to a second end that surrounds the three axis sensor; and wherein a conical compression spring is secured between the first end of the housing and around the shaft portion of the movable member to create a biasing force on the movable member to bias the movable member to a neutral position wherein no net force exists on the movable member.

12. The joystick of claim 11 wherein the movable member is of one piece construction.

13. The joystick of claim 11 wherein the movable member and actuating member are made of a transparent material.

14. The joystick of claim 13 wherein the transparent material is plastic.

15. The joystick of claim 13 wherein a light emitting diode is detected by a user through the transparent material of the movable member and actuating member.

16. The joystick of claim 11 wherein the movable member is formed of a transparent plastic material using an injection molding process wherein the magnet is over molded.

17. The joystick of claim 11 wherein the shaft portion of the movable member has a central axis and the magnet is positioned axially along the central axis.

18. The joystick of claim 17 wherein the spherical portion of the movable member has a center point and the magnet is not located on the center point.

19. The joystick of claim 11 wherein a seal is disposed around the housing and connects the housing to the actuating member.

20. The joystick of claim 11 wherein the magnet is a cylindrical magnet.

* * * * *